US007374055B2

(12) United States Patent
Hatcher et al.

(10) Patent No.: US 7,374,055 B2
(45) Date of Patent: May 20, 2008

(54) CONTAINER HAVING CONTROLLED TOP LOAD CHARACTERISTICS

(75) Inventors: Willie Hatcher, Hanover, PA (US); Toshi Kojitani, Lancaster, PA (US); David B. Heisner, York, PA (US); Bret Sabold, Bernville, PA (US)

(73) Assignee: Graham Packaging Company, L.P., York, PA (US)

( * ) Notice: Subject to any disclaimer, the term of this patent is extended or adjusted under 35 U.S.C. 154(b) by 477 days.

(21) Appl. No.: 11/020,050

(22) Filed: Dec. 22, 2004

(65) Prior Publication Data

US 2006/0131259 A1 Jun. 22, 2006

(51) Int. Cl.
*B65D 1/02* (2006.01)
*B65D 1/46* (2006.01)

(52) U.S. Cl. ..... 215/381; 215/384; 220/672; 220/675

(58) Field of Classification Search ..... 215/379–384, 215/398; 220/669, 672, 675
See application file for complete search history.

(56) References Cited

U.S. PATENT DOCUMENTS 4,127,206 A * 11/1978 Virog et al. ..... 215/385
4,579,260 A * 4/1986 Young et al. ..... 222/465.1
4,805,788 A 2/1989 Akiho
4,887,730 A * 12/1989 Touzani ..... 215/271
4,955,493 A * 9/1990 Touzani ..... 215/372
5,067,622 A * 11/1991 Garver et al. ..... 215/381
5,224,614 A * 7/1993 Bono et al. ..... 215/384
5,303,834 A 4/1994 Krishnakumar et al.
5,385,250 A * 1/1995 Pasquale ..... 215/374
5,407,086 A 4/1995 Ota et al.
6,016,932 A 1/2000 Gaydosh et al.
6,213,326 B1 * 4/2001 Denner et al. ..... 215/383
6,296,131 B2 * 10/2001 Rashid ..... 215/383
7,077,279 B2 * 7/2006 Melrose ..... 215/381

FOREIGN PATENT DOCUMENTS

EP 0 437 620 7/1991
EP 0 446 352 9/1991
EP 1 354 801 10/2003
GB 2025889 A * 1/1980

* cited by examiner

*Primary Examiner*—Sue A Weaver
(74) *Attorney, Agent, or Firm*—Knoble, Yoshida & Dunleavy, LLC

(57) ABSTRACT

A plastic container having a first portion, a second portion, and a waist between the first portion and the second portion. The waist includes a first angled portion coupled to the first portion, a second angled portion coupled to the second portion, and a curved portion connecting the first angled portion to the second angled portion for forming a deformable region for preventing a catastrophic failure of the waist when the plastic container is filled and capped and subjected to an external force.

17 Claims, 5 Drawing Sheets

CONTAINER HAVING CONTROLLED TOP LOAD CHARACTERISTICS

BACKGROUND OF THE INVENTION

1. Field of the Invention

The present invention relates generally to a plastic container, and more particularly to a plastic container having controlled top load characteristics.

2. Related Art

Container waists are known to provide the necessary rigidity to prevent ovalization of the container sidewalls and/or dome. U.S. Pat. No. 5,303,834 discloses a recessed circumferential ring, known as a "waist," in the side wall of the container to minimize shape distortion caused by filling with a hot product. This ring prevents a cylindrical container from ovalizing, especially in the tapered shoulder section of the container. However, such conventional container waists may not provide the requisite structure to prevent catastrophic failures of the dome caused by toploading.

BRIEF SUMMARY OF THE INVENTION

Exemplary embodiments of the invention provide a plastic container having a first portion, a second portion, and a waist between the first portion and the second portion. The waist includes a first angled portion coupled to the first portion, a second angled portion coupled to the second portion, and a curved portion connecting the first angled portion to the second angled portion for forming a deformable region for preventing a catastrophic failure of the waist when the plastic container is filled and capped and subjected to an external force.

In a further exemplary embodiment of the invention, to prevent a catastrophic failure of the waist of a plastic container, a deformable region controllably deforms in response to an external force, an internal pressure of the container increases radially, and a net vertical force is produced on a non-vertical surface of the container.

In a further exemplary embodiment of the container, the second portion of the container has a body of the container, a bumper coupled to an upper portion of the body and a base coupled to a bottom portion of the body. In such an embodiment, the second angled portion of the waist extends from said bumper at an angle and the angle reduces when the container is subjected to the external force.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
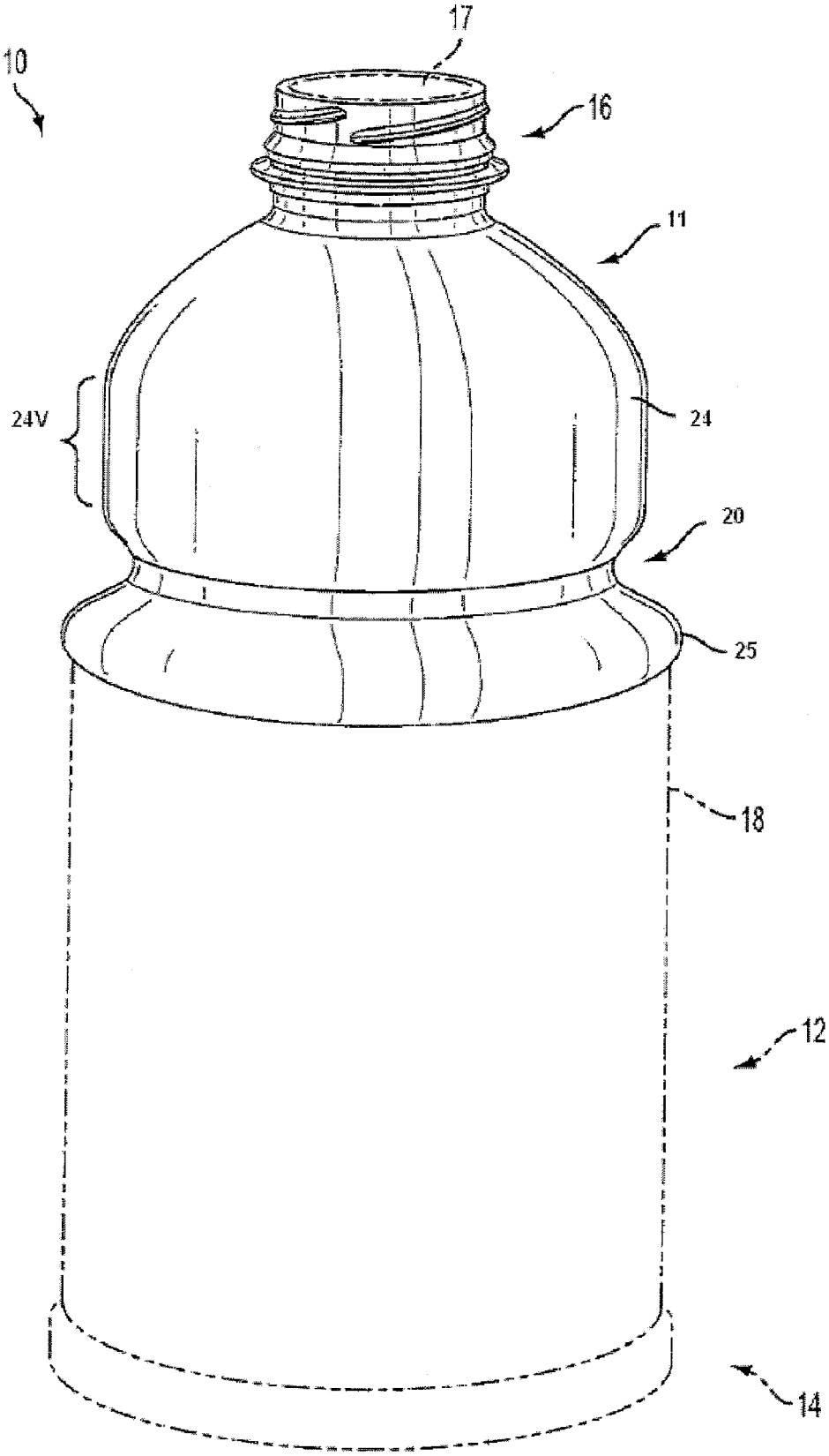
FIG. 1 depicts an exemplary embodiment of a container according to the present invention.

FIG. 1 depicts an exemplary embodiment of a container 10 according to an embodiment of the present invention. Container 10 may include an upper portion 11, a lower portion 12, a waist 20 and a base 14. Upper portion 11 may include a dome 24, and a finish 16, which has an opening 17 for receiving and pouring liquids. In an exemplary embodiment of the invention, dome 24 may be a bell-shaped dome. Lower portion 12 may include a container sidewall 18 that merges with base 14 and a label bumper 25 that merges with waist 20. In an exemplary embodiment of the invention, container sidewall 18 may be substantially cylindrical.

In an exemplary embodiment of the invention, as is shown in FIG. 1, for example, dome 24 of upper portion 11 may include vertical area **24*v* for labeling. In such an embodiment, vertical area 24*v* may contribute to optimizing topload resistance because the vertical surface is less likely to buckle during toploading, as will be explained in further detail below with respect to FIG. 3**.

Container 10 may be used to package a wide variety of liquid, viscous or solid products including, for example, juices, other beverages, yogurt, sauces, pudding, lotions, and soaps in liquid or gel form.

In an exemplary embodiment of the invention, container 10 may be made by conventional blow molding processes including, for example, extrusion blow molding, stretch blow molding and injection blow molding.

Further, container 10 may have a one-piece construction and may be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability.

Alternatively, the container may be prepared from a multilayer plastic material. In such an embodiment, the layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container may be prepared from PET using a stretch blow molding process.

Figure 2A:
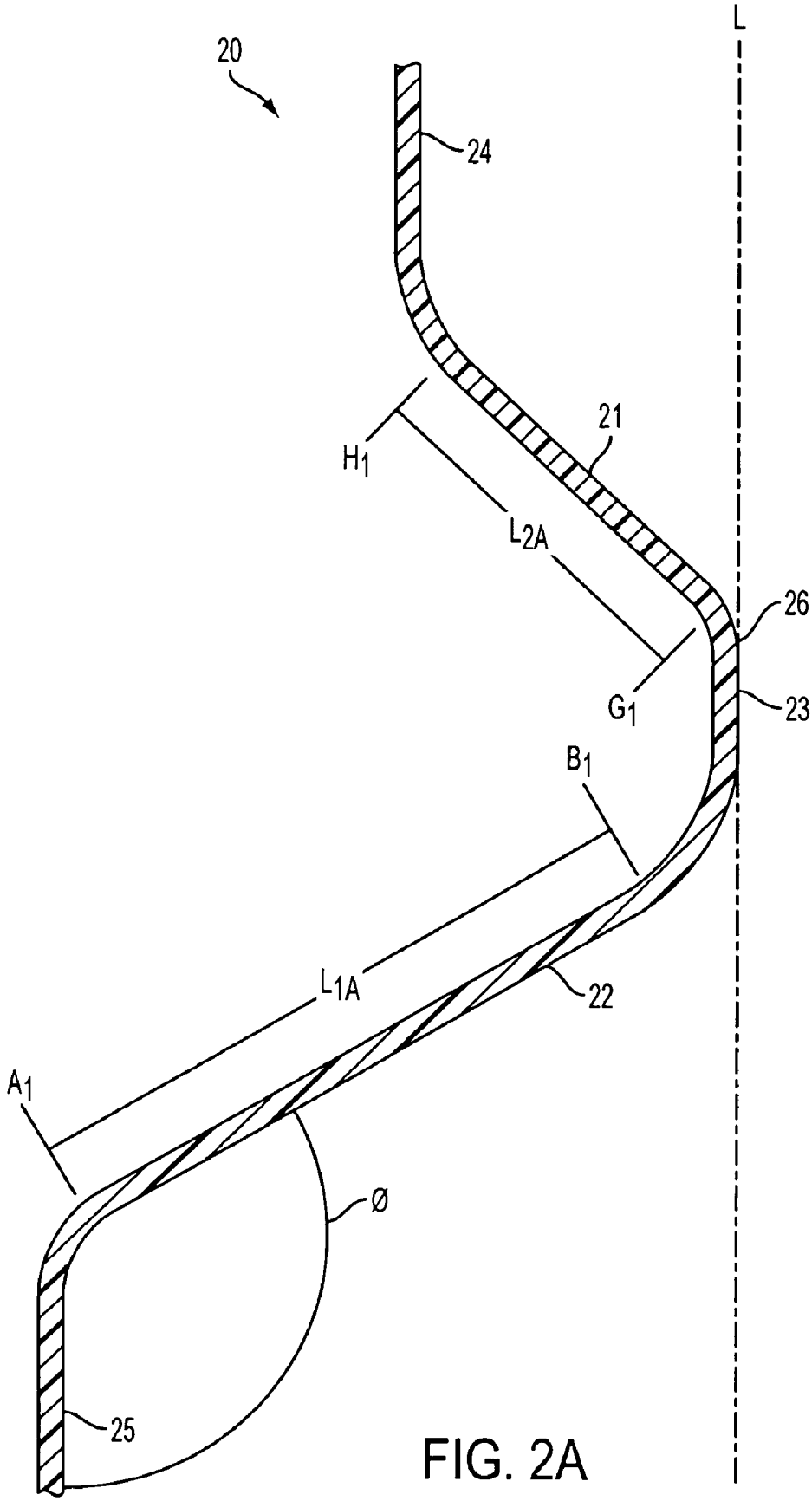
FIG. 2A depicts a cross-sectional view of an exemplary embodiment of a container according to the present invention.

FIG. 2A depicts a cross-sectional view of an exemplary waist 20 according to an embodiment of the present invention. Waist 20 may include a first angled portion 21 that merges with a dome wall 24 of the upper portion a container, a second angled portion 22 that merges with the label bumper 25 of a lower portion of a container, and a curved portion 23 that connects the first angled portion 21 to the second angled portion 22.

In an exemplary embodiment of the invention, second angled portion 22 may merge with label bumper 25 on the lower portion of a container at an angle θ. In an exemplary embodiment of the invention, for container that is not undergoing an external force caused by toploading, for example, angle θ may be between about 90° and 135°, for example, approximately 117°. As an external force from toploading, for example, is applied to a container, angle θ may be reduced.

As is shown in FIG. 2A, second angled portion 22 may have two endpoints $A_1$, $B_1$ that define a distance $L_{1A}$, which may be equal to the length of second angled portion 22. In an exemplary embodiment of the invention, distance $L_{1A}$ may be between about 0.25 and 2.00 inches. In a further exemplary embodiment of the invention, distance $L_{1A}$ may be approximately 0.55 inches. Similarly, first angled portion may have two endpoints $G_1$, $H_1$ that define a distance $L_{2A}$, which is equal to the length of the flat surface of first angled portion 21. In an exemplary embodiment of the invention, distance $L_{2A}$ may be between about 0.00 and 1.75 inches. In a further exemplary embodiment of the invention, distance $L_{2A}$ may be approximately 0.15 inches. In an exemplary embodiment of the invention, $L_{1A}$ may be greater than $L_{2A}$.

Further, as is shown in FIG. 2A, curved portion 23 may have an innermost point 26 that defines a longitudinal axis L. In an exemplary embodiment of the invention, when an external force is applied to a container, for example, by toploading, curved portion 23 may displace axially about longitudinal axis L.

Figure 2B:
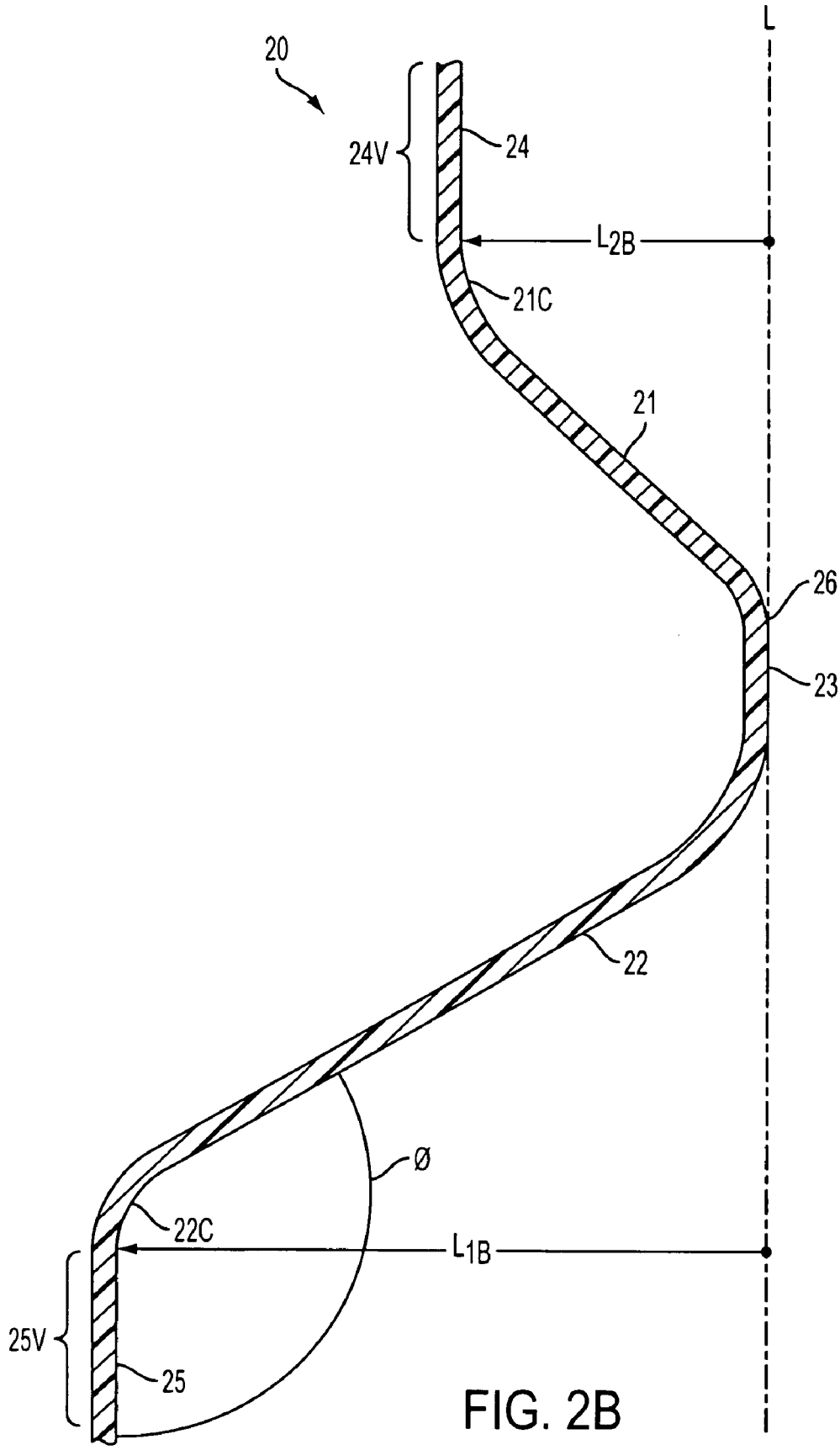
FIG. 2B depicts a cross-sectional view of an exemplary embodiment of a container according to the present invention.

In an alternative exemplary embodiment of the invention, as is shown in FIG. 2B, second angled portion 22 may have a length $L_{1B}$ that may he defined the radial distance from longitudinal axis L to the exterior point where curved portion 22*c* of second angled portion 22 meets vertical area 25*v* of label bumper 25. Similarly, first angled portion 22 may have a length $L_{2B}$ that may be defined as the radial distance from longitudinal axis L to the exterior point where curved portion 21*c* of first angled portion 21 meets vertical area 24*v* of dome 24. In such an embodiment, a ratio $L_{2B}$:$L_{1B}$ may be defined. In an exemplary embodiment of the invention, the ratio $L_{2B}$:$L_{1B}$ may 0 to 0.5. In a further exemplary embodiment of the invention, the ratio $L_{2B}$:$L_{1B}$ may be 0.375.

Figure 3:
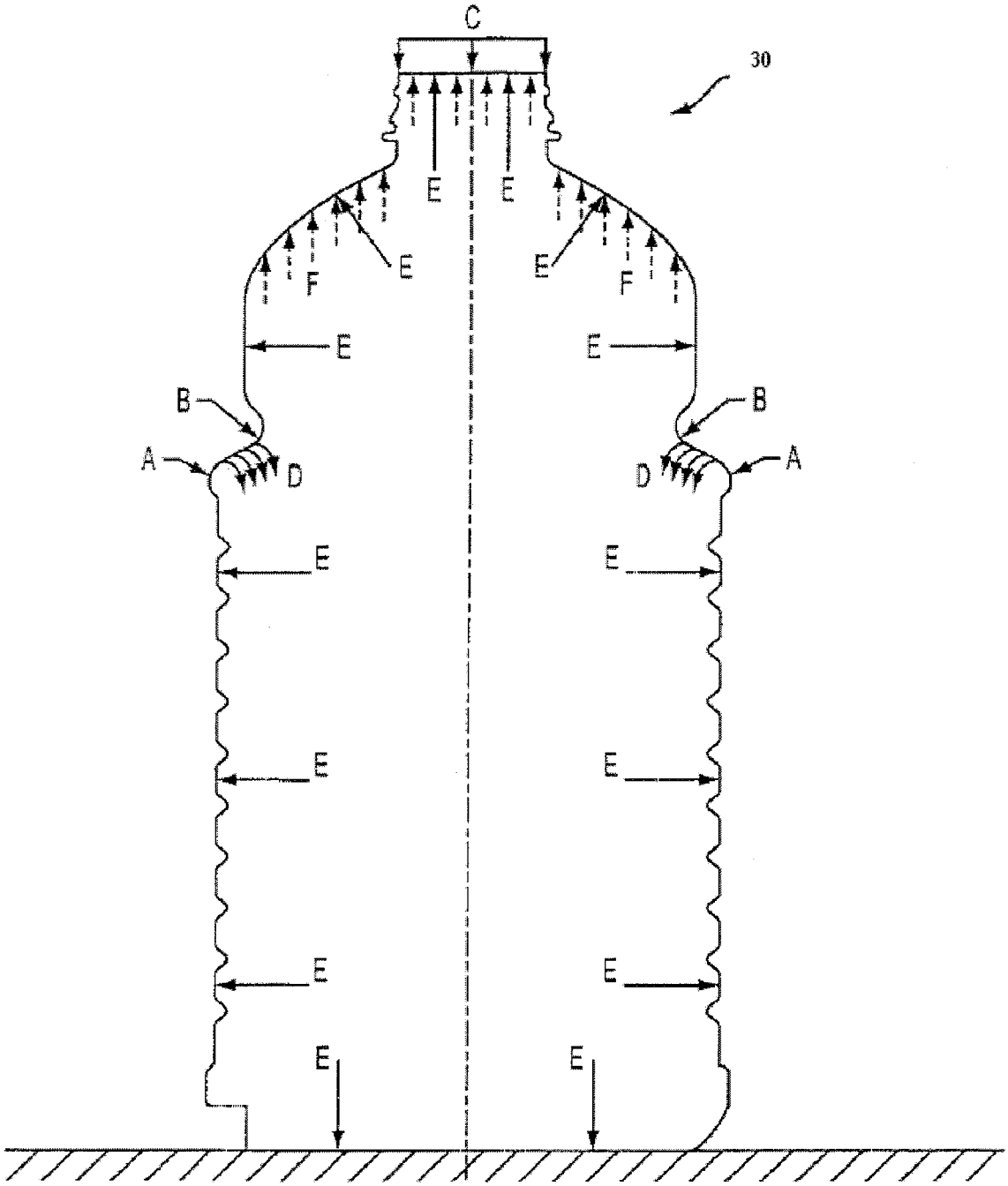
FIG. 3 depicts schematically distribution of topload forces in an exemplary container embodying the present invention.

FIG. 3 depicts a cross-sectional view of an exemplary embodiment of container 30. In such an embodiment, container 30 has improved topload characteristics when filled and capped. Topload refers to external forces that are applied to sealed containers as they are packed and shipped. Filled containers are typically packed in bulk in cardboard boxes, or plastic wrap, or both. A bottom row of packed filled containers is likely to support several upper tiers of filled containers, and potentially, several upper boxes of filled containers. Therefore, it is important that the containers have a top loading capability that is sufficient to prevent distortion from the intended container shape.

Conventional containers have exhibited a limited ability to withstand top loading during filling, capping and stacking for transportation. Overcoming these problems is important because it would decrease the likelihood of a container's top or shoulder being crushed, as well as inhibiting ovalization in this area. It is important to be able to stack containers so as to maximize the use of shipping space. Due to the weight of liquid-filled containers, the boxes often need reinforcing such as egg crate dividers to prevent crushing of the containers. The vulnerability of the containers to crushing can be increased by the deformation resulting from the added weight on the stacked containers.

Figure 4:
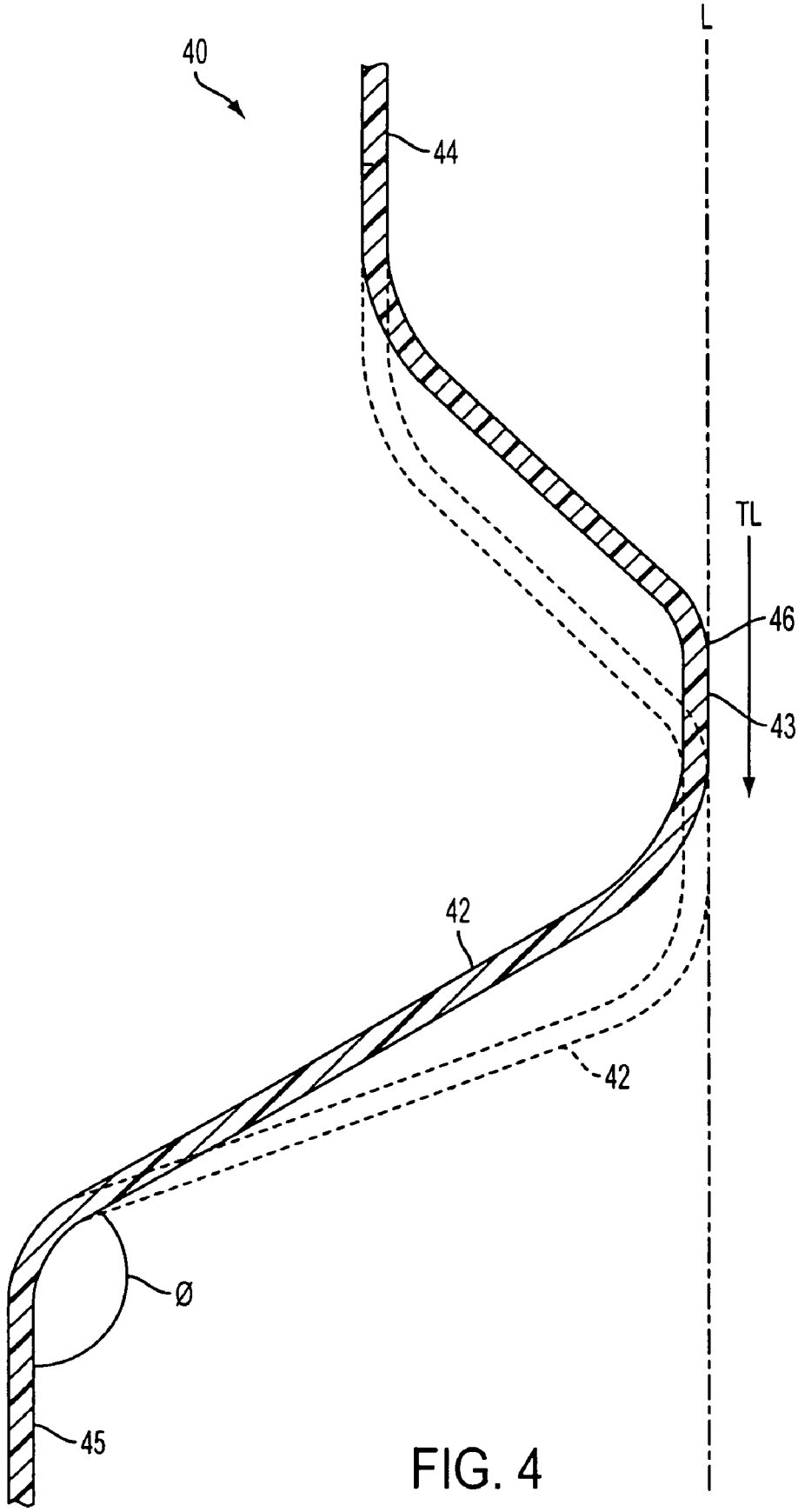
FIG. 4 depicts cross-sectional view of an exemplary embodiment of a container according to the present invention.

As shown in FIGS. 3-4, improvement in topload characteristics is achieved by the present invention through a controlled failure of the waist to eliminate catastrophic buckling of the container walls and increase internal resistance.

FIG. 4 depicts a cross-sectional view of an exemplary embodiment of a waist 40 that is subjected to an external force, such as toploading. As shown in FIG. 4, the solid lines represent an exemplary waist 40 that may be part of a container that is capped and filled, but has not been subject to an external force, while the dashed lines represent an exemplary waist 40 that may be part of a container that is capped and filled, and has been subjected to an external force TL. When a container comprising waist 40 is sub to an external force TL, such as toploading, a downward force may be exerted on the dome 44. As the external force TL is applied, an innermost point 46 of curved portion 43 of waist 40 may displace about a longitudinal axis L, and may cause second angled portion 42 to deform. When this occurs, for example, second angled portion 42 may sag inward and the angle θ, may be reduced to approximately 45 to 134°. In a further exemplary embodiment of the invention, the angle θ, may be reduced to approximately 90°.

In an exemplary embodiment of the invention, this improvement may be achieved through an effective "weakening" of the waist. In an exemplary embodiment of the invention as shown in FIG. 3, when the external force, such as a top load force C is applied to a container, the plastic is able to deflect and/or deform about endpoints A and B in the waist as shown by the arrows marked D. This deflection, in a filled and capped container, raises the internal pressure of the container labeled E. An increase in the internal pressure will resist the top load C by producing a net vertical force, labeled F, across all non-vertical surfaces of the container. In other words, when a top load C is applied to container 30, container 30 will yield vertically in such a way to maximize the displacement of internal volume, increase the internal pressure of container 30 and therefore optimize topload resistance.

In contrast to the present invention, prior containers have generally used a rigid waist portion specifically designed to resist deformation, i.e., be strengthened rather than weakened. Although this strengthening can prevent ovalization, when a topload force is applied, deformation must occur in some other portion of the container. This deformation can result in catastrophic buckling at the weakest point of the container, which may be in the dome sidewall or base, particularly where plastic in these regions is made thin during a molding process. By intentionally weakening the waist to permit a more predictable deflection or folding, the present invention takes advantage of the resulting internal pressure developed within the container to create a force resistant to toploading and catastrophic buckling of the container.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container; comprising:

a first portion;

a second portion;

a waist between said first portion and said second portion, said waist comprising a first angled portion coupled to said first portion, a second angled portion coupled to said second portion, and a curved portion connecting said first angled portion to said second angled portion for forming a deformable region for preventing a catastrophic failure of said waist when the plastic container is filled and capped and subjected to an external force, wherein an innermost portion of said curved portion defines a longitudinal axis;

wherein a first radial distance taken from the longitudinal axis to an exterior point where said first angled portion couples to said first portion is less than a second radial distance taken from the longitudinal axis to an exterior point where said second angled portion couples to said second portion; and wherein the ratio of the first radial distance to the second radial distance is between 0.0 and 0.5.

2. The plastic container according to claim 1, wherein, to prevent a catastrophic failure of said waist, said deformable region controllably deforms in response to the external force, an internal pressure of the container increases radially, and a net vertical force is produced on a non-vertical surface of the container.

3. The plastic container according to claim 1, wherein said second portion comprises a body of the container, a bumper coupled to an upper portion of the body and a base coupled to a bottom portion of the body, and wherein said second angled portion of said waist extends from said bumper at an angle and the angle reduces when the container is subjected to the external force.

4. The plastic container according to claim 3, wherein said second portion is a lower portion of the container.

5. The plastic container according to claim 1, wherein said first portion comprises a dome having a vertical wall.

6. The plastic container according to claim 5, wherein said first portion is an upper portion of the container.

7. The plastic container according to claim 1, wherein the first angled portion has a first length and the second angled portion has a second length and further wherein the second length is between 0.25 to 2.00 inches.

8. The plastic container according to claim 7, wherein the second length is approximately 0.55 inches.

9. The plastic container according to claim 7, wherein the first length of the first angled portion is between 0.00 to 1.75 inches.

10. The plastic container according to claim 9, wherein the first length is approximately 0.15 inches.

11. The plastic container according to claim 1, wherein when the plastic container is subjected to an external force, said innermost portion of said curved portion displaces axially along the longitudinal axis.

12. The plastic container according to claim 11, wherein when said innermost portion of said curved portion displaces axially along the longitudinal axis, said second angled portion deforms.

13. The plastic container according to claim 3, wherein the angle at which said second angled portion of said waist extends fern said bumper is between 90° and 135°.

14. The plastic container according to claim 13, wherein the angle at which said second angled portion of said waist extends horn said bumper is approximately 117°.

15. The plastic container according to claim 13, wherein during toploading of the container the angle at which said second angled portion of said waist extends hem said bumper is between 45° and 134°.

16. The plastic container according to claim 15, wherein during toploading of the container the angle at which said second angled portion of said waist extends from said bumper is approximately 90°.

17. The plastic container according to claim 1, wherein the ratio of the first radial distance to the second radial distance is 0.375.

* * * * *